US006497057B1

(12) United States Patent
Lee et al.

(10) Patent No.: US 6,497,057 B1
(45) Date of Patent: Dec. 24, 2002

(54) HEEL CUSHION

(75) Inventors: Andre Lee, Fremont, CA (US); Christian Tresser, Portland, OR (US)

(73) Assignee: Ariat International, Inc., Union City, CA (US)

( * ) Notice: Subject to any disclaimer, the term of this patent is extended or adjusted under 35 U.S.C. 154(b) by 0 days.

(21) Appl. No.: 09/431,012

(22) Filed: Nov. 1, 1999

(51) Int. Cl.[7] ..... A43B 21/26
(52) U.S. Cl. ..... 36/35 R; 36/27; 36/28
(58) Field of Search ..... 36/27, 28, 35 R, 36/37

(56) References Cited

U.S. PATENT DOCUMENTS

| | | | | | |
|---|---|---|---|---|---|
| 497,158 | A | * | 5/1893 | Allen | 36/37 |
| 554,988 | A | * | 2/1896 | Cushing | 36/35 R |
| 795,502 | A | * | 7/1905 | Gareau | 36/37 |
| 930,990 | A | * | 8/1909 | Rogers | 36/37 |
| 968,020 | A | * | 8/1910 | Yandoli | 36/27 |
| 1,708,683 | A | * | 4/1929 | Roberts | 36/37 |
| 2,078,311 | A | * | 4/1937 | Boag | 36/35 R |
| 2,274,890 | A | * | 3/1942 | Cunningham | 36/37 |
| 4,794,707 | A | * | 1/1989 | Franklin et al. | 36/35 R |
| 4,815,221 | A | * | 3/1989 | Diaz | 36/28 |
| 4,835,884 | A | * | 6/1989 | Bianchini et al. | 36/24.5 |
| 5,077,915 | A | * | 1/1992 | Gross | 36/28 |
| 5,203,793 | A | * | 4/1993 | Lyden | 36/88 |
| 5,224,277 | A | * | 7/1993 | Sang Do | 36/28 |
| 5,224,278 | A | * | 7/1993 | Jeon | 36/27 |
| 5,311,674 | A | * | 5/1994 | Santiyanont et al. | 36/35 R |
| 5,396,718 | A | * | 3/1995 | Schuler et al. | 36/27 |
| 5,544,431 | A | * | 8/1996 | Dixon | 36/37 |
| 5,561,920 | A | * | 10/1996 | Graham et al. | 36/27 |
| 5,649,374 | A | * | 7/1997 | Chou | 36/27 |
| 5,720,117 | A | * | 2/1998 | Toschi | 36/76 R |
| 5,937,544 | A | * | 8/1999 | Russell | 36/27 |

FOREIGN PATENT DOCUMENTS

| | | | | | |
|---|---|---|---|---|---|
| FR | 2678810 | A | * | 1/1993 | 36/37 |

* cited by examiner

*Primary Examiner*—Mickey Yu
*Assistant Examiner*—Troy G. Arnold
(74) *Attorney, Agent, or Firm*—Carr & Ferrell LLP

(57) ABSTRACT

A shoe cushion system integrated in a heel portion of a shoe includes a cavity in the heel of the sole for housing a honeycomb cushion and a strike pad to reduce foot fatigue. A spring is located directly above the strike pad and directs force from the impact of a foot on the heel portion of the shoe. An extendable portion of the spring is positioned within a lasting board aperture, while a flat portion overlaps the lasting board. This spring is made from a gel-like substance, which allows the extendable portion to project through the aperture when force is applied to the heel portion of the shoe. The extendable portion of the spring transfers force onto the strike pad, which in turn presses down on the honeycomb cushion. This honeycomb cushion compresses under the pressure of the strike pad to absorb some of the force.

14 Claims, 4 Drawing Sheets

HEEL CUSHION

BACKGROUND OF THE INVENTION

1. Field of the Invention

This invention relates generally to footwear and more particularly to a heel cushioning system.

2. Description of the Background Art

A conventional shoe (or boot, hereinafter "shoe") heel is a solid block located at the back of the sole of the shoe. Heels elevate the wearer, and receive the brunt of the shocks of walking on the shoes. Heels are also often designed to be fashionable.

Consumer demands have induced manufacturers to make shoes more comfortable. For example, some sport shoes include air pumps which inflate bladders in the sides, heel or mid sole of the shoe to absorb pressure on a foot when taking a step and to cushion the arch and heel of the wearer's foot. Although air pumps and bladders can cushion a foot, they do not minimize forces on the wearer's heel. Meanwhile, in taking a step, a person's heel typically hits the ground first and supports most of the person's weight. The repeated stress may injure the heel. Therefore, there is a need for a shoe cushion system integrated in the heel portion of a shoe to minimize stress on a wearer's foot.

SUMMARY OF THE INVENTION

The present invention provides a cushioning system integrated in the heel of a shoe. This system advantageously reduces foot fatigue associated with non-cushioned shoes. The shoe cushioning system preferably includes a cavity in a shoe heel which houses a strike pad and, beneath it, a honeycomb cushion. A shoe lasting board, including a shank, is positioned over the strike pad and the outsole, and has a hole in the heel portion. A heel spring, capable of directing force from the impact of a foot on the heel portion of the shoe, is located over the lasting board and directly above the strike pad. An extendable portion of the heel spring projects downwardly through the hole in the lasting board. Because the heel spring is made from a gel-like substance, a person's heel forcing down on the shoe tends to project the extendable portion of the heel spring through the hole in the lasting board. The extendable portion of the spring transfers force from the wearer's heel onto the strike pad, which in turn presses down on the honeycomb cushion. The design of the honeycomb cushion allows it to compress under, and absorb some of, the pressure on the strike pad.

DETAILED DESCRIPTION OF THE PREFERRED EMBODIMENT

Figure 1:
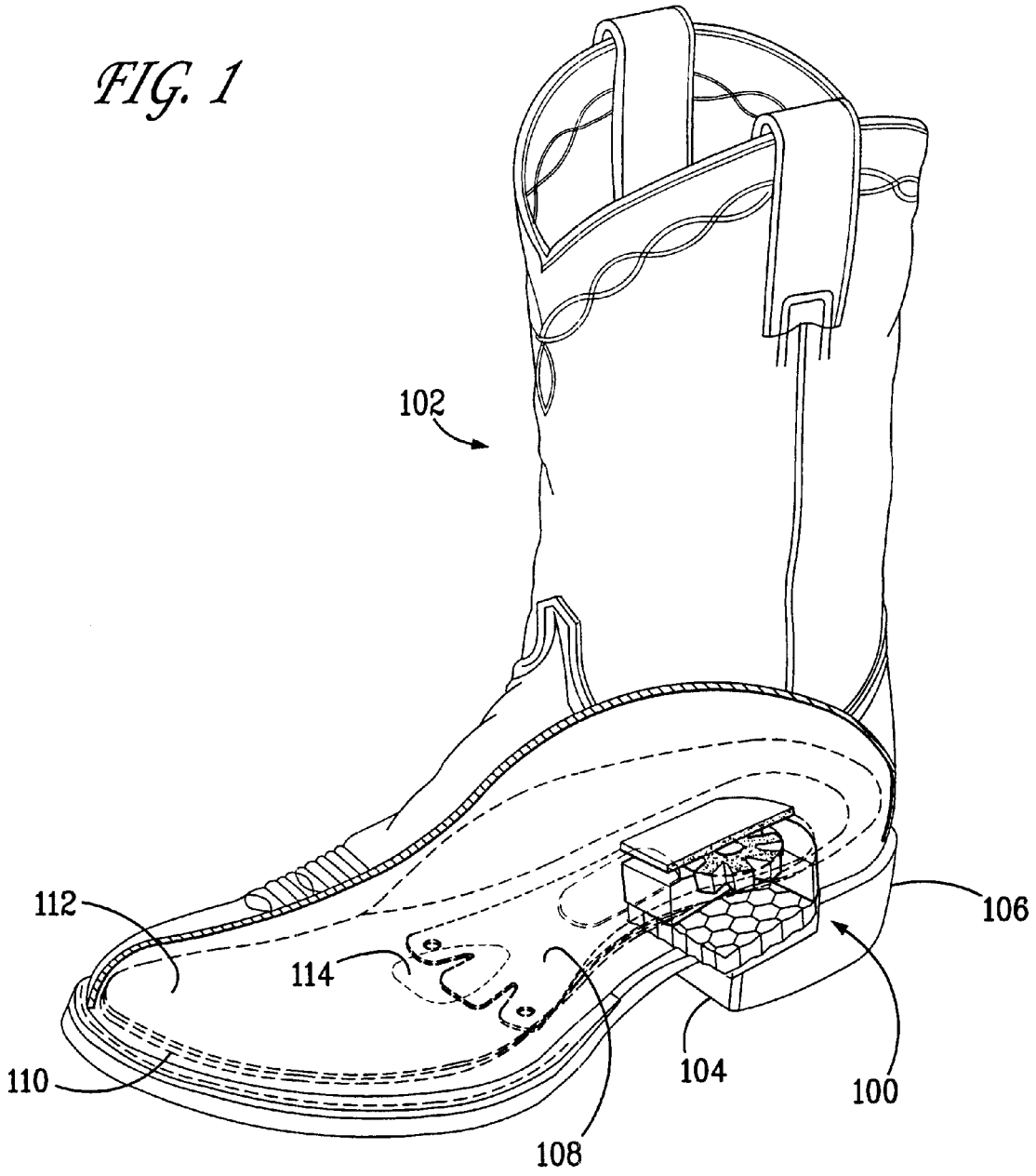
FIG. 1 is a cutaway perspective view of components of a shoe according to the invention.

FIG. 1 shows the invention, a heel cushioning system 100, used in a boot 102. Boot 102 also has a heel 104 and an outsole 106, above which lies a lasting board 110 having an embedded carbon fiber shank 108 for extra support in the heel 104 and arch portions of boot 102. Other types of shanks may be used in place of the carbon fiber shank.

Lasting board 110 supports a footbed 112 including multiple layers of material sandwiched together. The bottom layer is preferably made of ethyl vinyl acetate (EVA) to be resilient and cushion the entire bottom of the foot. A resilient support pad 114 embedded in the middle section of footbed 112 supports the metatarsal bones of a wearer's foot. One or more layers of fabric, leather, or synthetic fiber-like material are affixed to the top surface of the bottom layer. Areas of the top two layers of footbed 112 are visible from above the shoe and improve the looks of boot 102.

Figure 2:
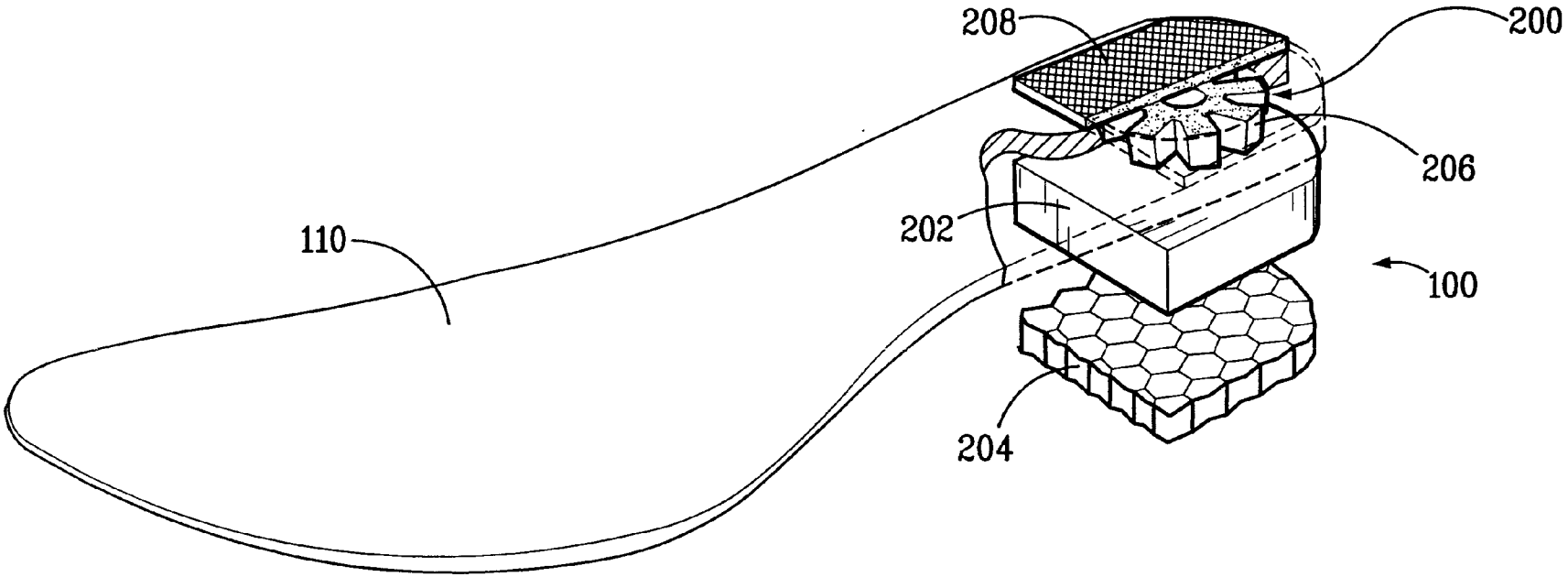
FIG. 2 is an exploded perspective view of the components of the heel of the shoe of FIG. 1.

FIG. 2 is an exploded perspective view of integrated cushioning system 100, which includes (in descending order) a heel spring 200 (for absorbing and directing the heel force), a strike pad 202 (for absorbing and distributing the heel force), and a cushion 204 (for absorbing the heel force).

Heel spring 200 includes an extendable portion 206 and, molded to the top surface of portion 206, a flat portion 208. Heel spring 200 is preferably made of a gel-like substance such as polyethylene, although other resilient materials may be suitable. When assembled with the other components in cushion system 100, extendable portion 206 protrudes through an aperture (306, FIG. 5) in lasting board 110 and shank 108, while flat portion 208 overlaps the top surface of lasting board 110.

In taking a step, a person's foot typically bears down hardest on the heel portion of a shoe. The force applied to the flat portion 208 of heel spring 200 urges the extendable portion 206 through the aperture 306 to transfer force onto the underlying strike pad 202. The stiffness of strike pad 202 allows strike pad 202 to distribute force from heel spring 200 to cushion 204. Strike pad 202 is preferably composed of ethyl vinyl acetate (EVA), but could alternatively be made of other suitable materials.

Figure 4:
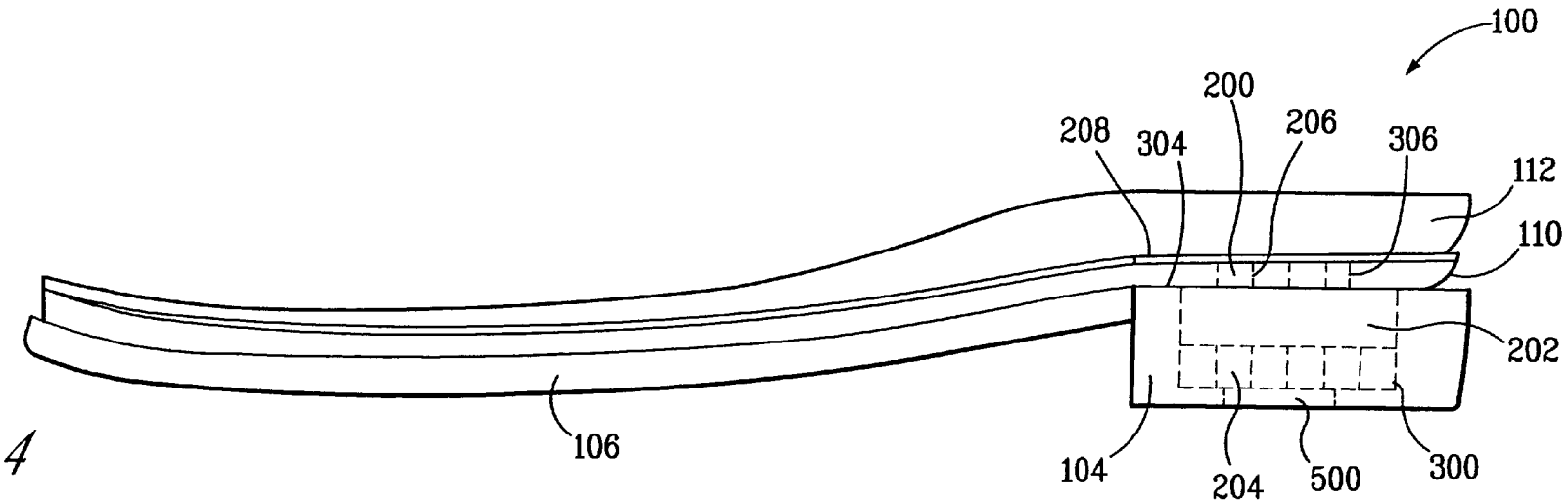
FIG. 4 is a side view of a bottom portion of a shoe with the integrated shoe cushioning system.
Figure 6:
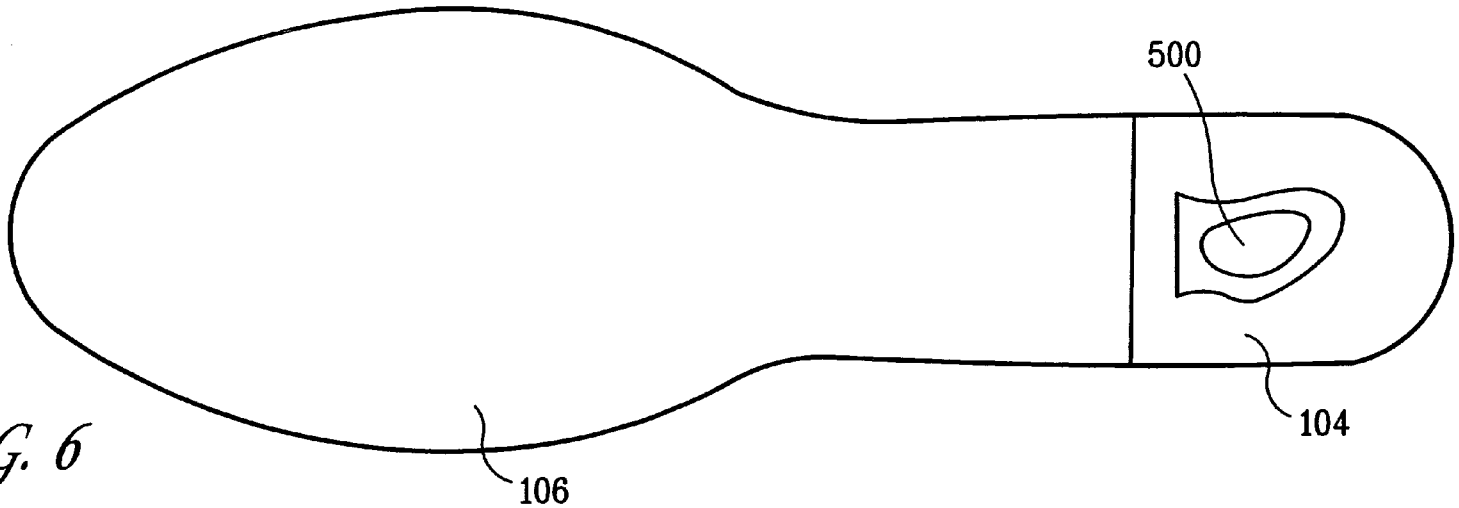
FIG. 6 is a bottom view of the shoe sole including a heel window.

Cushion 204 is preferably a slab-shaped honeycomb structure positioned with its top surface immediately beneath strike pad 202 and its bottom surface immediately above a cushion window 500 (FIGS. 4 and 6). Cushion 204 is preferably made of polyurethane formed as a honeycomb of hexagonal cells sandwiched between two sheets. The honeycomb structure of cushion 204 compresses under loads and thereby absorbs energy.

Figure 3:
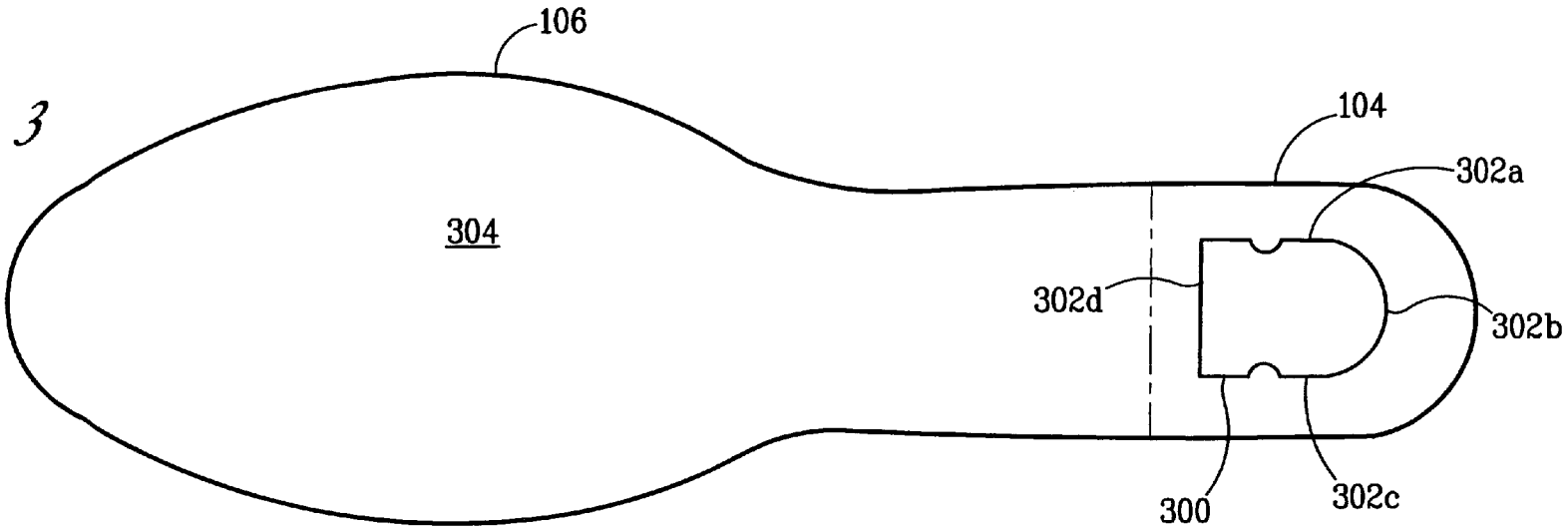
FIG. 3 is a top view of a shoe sole including a heel cavity.

FIG. 3 is a top view of sole 106, showing its top surface 304 with the heel portion 104 having a heel cavity 300 defined by walls 302*a–d* for securely encompassing honeycomb cushion 204 and strike pad 202 (FIGS. 2 and 4). Cavity walls 302*a–d* may be curved, zigzagged, indented, or configured otherwise to vary the shape of the heel cavity 300.

FIG. 4 is a side view of the bottom portion of a shoe showing a sole 106 and heel 104 having a top surface 304 with a cavity 300 (as shown in dashed lines) in the heel 104. The bottom of cavity 300 forms a semi-transparent cushion window 500 (also visible in FIG. 6). Lasting board 110 has an aperture 306 located directly over heel cavity 300. The heel spring 200 extendable portion 206 fits securely within aperture 306, and flat portion 208 overlaps the top surface of lasting board 110. Footbed 112 is disposed over lasting board 110 and cushions the sole of the wearer's foot. Portions of the top layers of footbed 112 are visible from above the boot.

When the wearer of the shoe takes a step and heel 104 strikes the ground, momentum forces the wearer's heel against the heel portion of footbed 112 and the wearer's foot down on footbed 112. This forces the extendable portion 206 of heel spring 200 through aperture 306 and against strike pad 202, transferring the load onto, and depressing honeycomb cushion 204, which compresses to absorb energy. Honeycomb cushion 204 is elastic and resilient, and, after absorbing energy, quickly springs back to its uncompressed shape.

Figure 5:
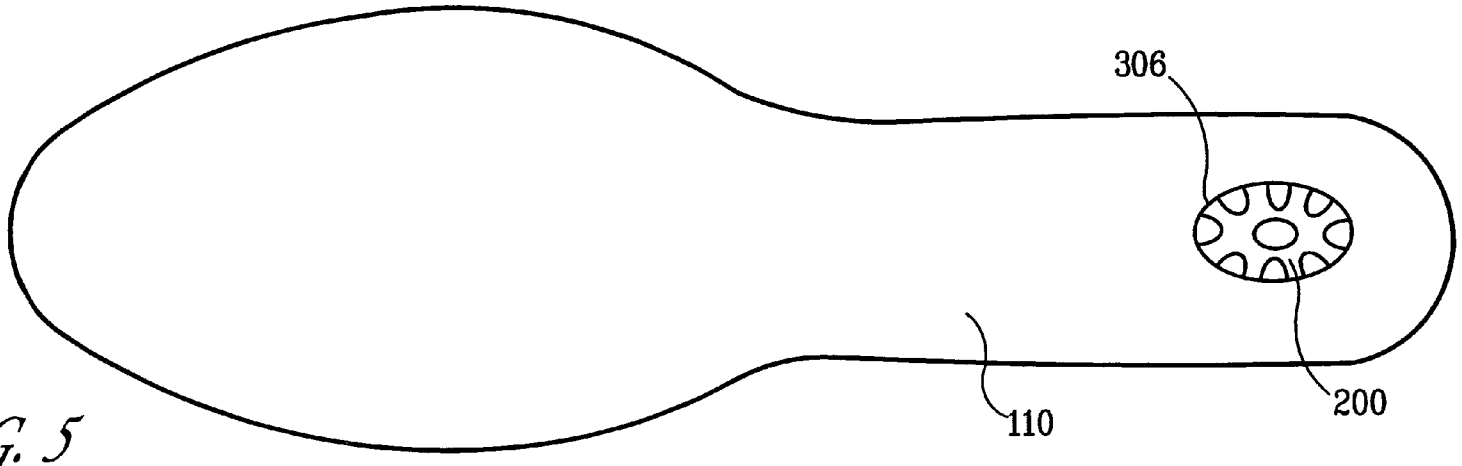
FIG. 5 is a bottom view of a lasting board with a gel spring projecting through a hole in the lasting board.

FIG. 5 is a bottom view of lasting board 110 and gel spring 200 extendable portion 206 located in aperture 306. The extendable portion 206 is preferably designed with spokes to facilitate projecting beyond the aperture when compressed, to press down against the strike pad 202 (not shown) located immediately below the heel spring 200.

FIG. 6 is a bottom view of sole 106. The bottom portion of heel 104 encompasses a cushion window 500 made of a clear rubber which reveals the honeycomb cushion 204 (FIG. 2) disposed directly above cushion window 500. The window 500 can be transparent or colored, could have a different shape, and could be made of other materials.

The invention has been described above with reference to specific embodiments. It will be apparent to those skilled in the art that various modifications may be made and other embodiments can be used without departing from the broader scope of the invention. Therefore, these and other variations upon the specific embodiments are intended to be covered by the present invention, which is limited only by the appended claims.

What is claimed is:

1. An integrated shoe cushion system comprising:

a shoe sole including a heel portion, said heel portion defining a cavity;

a slab-shaped cushion enclosed within the cavity for absorbing a force created by an impact of a foot against said heel portion;

a strike pad enclosed within the cavity above the cushion for distributing the force onto the cushion; and a polymer heel spring disposed directly above the strike pad for directing the force onto the strike pad.

2. The cushion system of claim 1 wherein the cavity extends from a top surface of the sole to a cushion window in a bottom surface of the sole.

3. The cushion system of claim 2 wherein the cushion window is made of rubber.

4. The cushion system of claim 3 wherein the rubber is transparent.

5. The cushion system of claim 1 wherein the cushion comprises a honeycomb structure.

6. The cushion system of claim 1 wherein the cushion is made of polyurethane.

7. The cushion system of claim 1 wherein the strike pad is made of ethyl vinyl acetate.

8. The cushion system of claim 1 wherein the heel spring comprises a gel spring.

9. The cushion system of claim 8 wherein the gel spring is made of polyethylene.

10. The cushion system of claim 8 wherein the gel spring comprises an extendable portion and a flat portion.

11. The cushion system of claim 10 wherein the extendable portion of the gel spring is spoked.

12. The cushion system of claim 10 wherein the extendable portion of the gel spring is disposed within an aperture of a lasting board.

13. The cushion system of claim 12 wherein the aperture is located in a heel portion of the lasting board.

14. The cushion system of claim 12 wherein a shoe shank is embedded within the lasting board.

* * * * *